US005986636A

United States Patent [19]

Wu

[11] Patent Number: 5,986,636

[45] Date of Patent: Nov. 16, 1999

[54] METHOD AND APPARATUS OF MODIFYING DISPLAY ASPECT AND POSITION ON A MONITOR

[75] Inventor: Tsung-Hsun Wu, Taoyuan, Taiwan

[73] Assignee: Acer Peripherals, Inc., Taoyuan, Taiwan

[21] Appl. No.: 08/845,415

[22] Filed: Apr. 25, 1997

[30] Foreign Application Priority Data

Feb. 5, 1997 [TW] Taiwan ..... 86101433

[51] Int. Cl.[6] ..... G09G 5/00

[52] U.S. Cl. ..... 345/132; 345/127

[58] Field of Search ..... 345/132, 127, 345/112, 129, 130, 342, 439

[56] References Cited

U.S. PATENT DOCUMENTS

| | | | |
|---|---|---|---|
| 4,990,902 | 2/1991 | Zenda | 345/132 |
| 5,031,118 | 7/1991 | Morizot . | |
| 5,276,458 | 1/1994 | Sawdon | 345/132 |
| 5,579,029 | 11/1996 | Arai et al. | 345/132 |
| 5,592,194 | 1/1997 | Nishikawa | 345/132 |
| 5,736,971 | 4/1998 | Shirai | 345/127 |

FOREIGN PATENT DOCUMENTS

| | | |
|---|---|---|
| 19637831A1 | 3/1997 | Germany . |
| 3722169C2 | 6/1997 | Germany . |

*Primary Examiner*—Matthew Luu
*Attorney, Agent, or Firm*—Pillsbury Madison & Sutro

[57] ABSTRACT

A method of modifying the display aspect and the display position as the display mode of a computer system changes. In this present invention, a plurality of display parameter sets are previously provided. Each display parameter set, dedicated to one of the predefined display modes, at least includes the front porch times and the back porch times of the horizontal synchronizing signal and the vertical synchronizing signal. Using these previously prepared display parameters and the transmission between the computer and the monitor, the monitor can be set to be proper timing corresponding to a new display mode.

18 Claims, 7 Drawing Sheets

METHOD AND APPARATUS OF MODIFYING DISPLAY ASPECT AND POSITION ON A MONITOR

BACKGROUND OF THE INVENTION

1. Field of the Invention

The present invention in general relates to a display technology of a computer system, more specifically, to a computer system that can prevent abnormal display aspect and display position on a monitor due to changing of the display mode in the computer system and can automatically adjust the display aspect and the display position in accordance with the various display modes applicable to the monitor.

2. Description of the Prior Art

FIG. 1 (Prior Art) illustrates a blocking diagram of a display architecture in a conventional personal computer system. In FIG. 1, the computer system may be divided into computer 1 (the left portion of the dashed line) and monitor 60. Microprocessor 10 is a core device of computer 1, which can handle control, mathematical operation and peripheral interruption processes. Chipset 20 is used to bridge between microprocessor 10 and the Peripheral Component Interconnection (PCI) bus. In addition, microprocessor 10 can access main memory 30 via chipset 20. For Intel Pentium Pro processors, chipset 20 may be implemented by the Intel 82441FX PCI Bridge and Memory Controller (PMC) and 82442FX Data Bus Accelerator (DBX). Chipset 40 is used to control communication between the PCI bus and the ISA bus, such as the Intel 82371SB PCI/ISA IDE Accelerator (PIIX3). Video display card 50 inserted into the ISA bus is used to manipulate display information and feed video signals and accompanying synchronizing signals to monitor 60 via bus or lead 70. Video display cards may share the image-processing workload for microprocessors, thereby improving the resultant performance of the overall system. In addition to the video display cards, a dedicated image chipset installed in a motherboard may be used to perform such a function. In addition, a video display card designed for a PCI bus may be used to achieve high-speed data transmission.

Synchronizing signals and video signals indicate the display appearance and display details of monitor 60. Synchronizing signals, including a horizontal synchronizing signal and a vertical synchronizing signal, are directly or indirectly fed into a deflection circuit of monitor 60, controlling an electron beam gun scanning the display screen of monitor 60. Video signals are used to control the brightness and the color of the scanned display screen. Traditionally, there are two approaches to controlling the deflection circuit of the monitor according to the horizontal/vertical synchronizing signals. The first approach is to reproduce vertical/horizontal blanking synchronizing signals from the original vertical/horizontal synchronizing signals, to adjust the vertical/horizontal blanking synchronizing signals in accordance with the phase of the video image, and to apply these blanking synchronizing signals to drive the deflection circuit. The second approach is to apply the original synchronizing signals from the video card to directly drive the deflection circuit. Thereupon, currents flowing through the horizontal/vertical deflection yokes are modified in accordance with the present video image. Basically, both of these approaches can modify the display aspect and the display position of the monitor.

The video signals transmitted from video display card 50 to monitor 60 include red, blue and green color signals. The synchronizing signals include the horizontal synchronizing signal and the vertical synchronizing signal. In a non-interlaced display mode, a picture frame defined by the vertical synchronizing signal is composed of a plurality scanning lines defined by the horizontal synchronizing signal. FIG. 2 (Prior Art) depicts timing diagrams of a video signal and a corresponding synchronizing signal. In FIG. 2, the depicted video signal represents image data in a picture frame when the depicted synchronizing signal is the vertical synchronizing signal. In addition, the depicted video signal represents image data in a scanning line when the depicted synchronizing signal is the horizontal synchronizing signal. The timing relation between the video signal and the synchronizing signal depicted in FIG. 2 is described as follows. Symbol A denotes the synchronizing pulsed time, and the time period between the two neighboring synchronizing pulses is defined as the total time of a picture frame or a scanning line. Symbols B and F denote the back porch time and the front porch time, respectively. Front porch time F, synchronizing pulsed time A and back porch time B are called a blanking time. The blanking time is used to define the flyback time when an electron beam gun finishes a scanning line or a picture frame and then restarts a next scanning line or a next picture frame. The color setting of the video signal corresponding to the flyback time must be darkest, preventing the electron beam gun from lighting the display screen during this period. Symbols C and E denote a left/upper frame edge time or a right/lower frame edge time. Symbol D denotes the addressable time, defining the period of image data to be displayed on the monitor. Periods C, D and E are called an active video time.

Practically, various video display cards fabricated by different manufacturers may output different video signals (red, green and blue) and synchronizing signals (horizontal and vertical). To bridge such differences, the Video Electronics Supplier Association (VESA) has proposed a set of standardized synchronizing parameters for various display modes. For example, the proposed synchronizing parameters for a display mode with a vertical scanning frequency of 72 Hz and a display resolution of 640×480 pixels are listed as follows:

Horizontal scanning:
total scanning time: 26.413 μsec;
synchronizing pulsed time: 1.270 μsec;
front porch time: 0.508 μsec; and
back porch time: 3.810 μsec;
Vertical scanning:
total scanning time: 13.735 msec;
synchronizing pulsed time: 0.079 msec;
front porch time: 0.026 msec; and
back porch time: 0.528 msec.

These proposed display modes have different timing specifications for various combinations of video display cards and monitors. Theoretically, if all video display cards fabricated by various manufacturers comply with these standardized specifications proposed by VESA to output the video signals and the synchronizing signal, the monitors may previously store a plurality of sets of display parameters corresponding to these display modes and retrieve them as required, optimizing the display aspect and the display position. Related technologies, such as display modes, parameter storing and parameter retrieving, have been disclosed in U.S. Pat. No. 5,021,713, "Display," Arai et al., and will not be further described.

At present, however, most of the video display cards do not completely conform with the proposed standardized specifications, except for the definition of the picture resolution in the active video time. This is the result of various practical considerations, such as technical capability and production cost. Since the timing characteristics of the video signals and the synchronizing signals generated by various video display cards are quite different, a step for manually modifying the display aspect and the display position must be taken to adjust the timing parameters when a display configuration has been altered.

Some commercial monitors provide an automatic adjustment function to solve the problems caused by manually adjusting the monitor, such as errors caused by manual adjustment and the extra cost of adding an additional adjusting circuit. The automatic adjustment function optimizes the monitor display by the following steps. First, the active video time is determined by an auto-detection technique. The detected active video time is used to determine the front porch time and the back porch time. Then the timing relation between the active region and the front/back porch times is modified to meet the standardized specifications by calculating the front porch time, the synchronizing pulsed time and the back porch time.

However, such an automatic adjustment means does not work in some circumstances. The active video time of the video signals may not carry enough image data that can be detected by the above-indicated auto-detection technique. For example, in a text mode of the DOS environment, the visible region of the monitor is merely a portion of displaying a prompt or input/output letters. It is evident that a portion of the active video time of the video signals does not contain any image data and cannot be detected. On the other hand, in a graphic mode of the Windows environment, the whole active video time of the video signals is visible. Therefore, an abnormal display may occur owing to the auto-detection technique when the computer system is operated in the DOS environment, and display modes or the operation environment (such as switching from the Windows environment into the DOS environment) are changed.

FIG. 3A (Prior Art) depicts a display screen of a computer system operated in a graphic environment (such as the Microsoft Windows environment) and FIG. 3B (Prior Art) illustrates timing diagrams of the corresponding video signal and synchronizing signal. In this case, the video signal has detectable image data during the active video time (including front/back edge times and addressable time). Therefore, a monitor using the conventional auto-detection technique can exactly detect the front porch time and the back porch time. On the other hand, FIG. 3C (Prior Art) depicts a display screen of a computer system operated in a text environment and FIG. 3D (Prior Art) illustrates timing diagrams of the corresponding video signal and synchronizing signal. It is evident that the image data carried by the shown video signal do not completely occupy the defined active video time. Therefore, errors may occur when detecting timing characteristics. Accordingly, conventional auto-detection technique cannot achieve the purpose of automatically modifying the display aspect and the display position.

SUMMARY OF THE INVENTION

Therefore, an object of the present invention is to provide a method of modifying the display aspect and the display position, which may automatically modify the display aspect and the display position and prevent an abnormal display when the display mode changes.

Another object of the present invention is to provide a method of modifying the display aspect and the display position, which can simplify the setup procedure of the monitor driver, thereby achieving a function of "Plug & Play."

A further object of the present invention is to provide a computer configuration that can perform the above-indicated method of modifying the display aspect and the display position.

The present invention achieves the above-indicated objects by providing a first method of modifying the display aspect and the display position on a monitor of a computer system when the display mode of the computer system changes. First, a plurality of display parameter sets are previously maintained. When the display mode of the computer system changes, one of the display parameter sets corresponding to a new display mode is selected. Then the selected display parameter set is transmitted to the monitor via a bus connected between the computer and monitor. Synchronizing signals generated by an video-output device of the computer system are also sent to the monitor. Finally, an adjustment amount corresponding to the selected display parameter set and the synchronizing signals is generated and used to modify the display aspect and the display position.

Furthermore, the present invention also provides a second method of modifying the display aspect and the display position. First, a plurality of display parameter sets are previously maintained in the monitor. When the computer system is powered on, these display parameter sets are fetched and stored into a main memory of the computer. When the display mode of the computer system changes, one of the display parameter sets corresponding to the new display mode is selected. Then the video-output device generates modified synchronizing signals corresponding to the new display mode in view of the selected display parameter sets. Finally, the display aspect and the display position are modified according to the modified synchronizing signals.

Various other objects, advantages and features of the present invention will become readily apparent from the detailed description, claims, and accompanying drawings.

BRIEF DESCRIPTION OF THE DRAWINGS

The following detailed description, given by way of example and not intended to limit the invention solely to the embodiments described herein, will best be understood in conjunction with the accompanying drawings, in which.

DETAILED DESCRIPTION OF THE PREFERRED EMBODIMENTS

As described above, conventional monitors may exhibit an abnormal display due to detecting an incorrect display mode. Therefore, the present invention utilizes another display-modifying scheme to overcome such a problem. In a computer system, the computer installed with a processor can always recognize the exact display mode to be applied to the monitor during operation. Therefore, using the display information acquired by the processor of the computer, the monitor can be set to a correct display mode and will not exhibit an abnormal display. In this present invention, a plurality of display parameter sets are previously provided. Each display parameter set, dedicated to one of the predefined display modes, includes the front porch times and the back porch times of the horizontal synchronizing signal and the vertical synchronizing signal. If necessary, each set may further include the total times and the synchronizing pulsed times of the horizontal synchronizing signal and the vertical synchronizing signal. Using these previously prepared display parameters and the transmission between the computer and the monitor, the monitor can be set by proper timing corresponding to the current display mode.

Here, two embodiments pertaining to the present invention are described as follows with reference to the accompanying drawings.

First Embodiment

Figure 1:
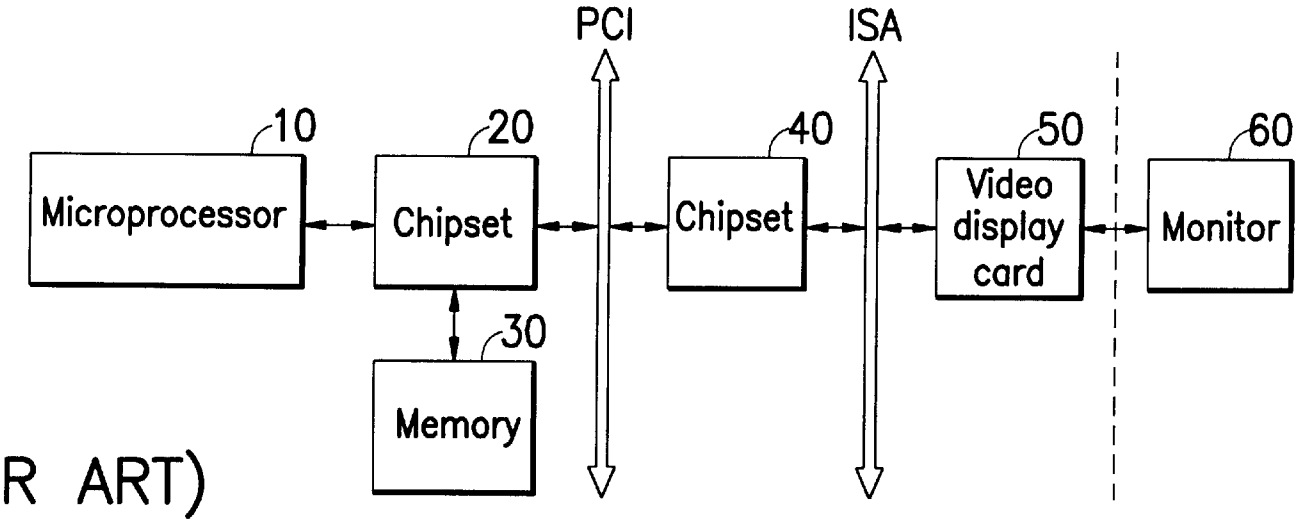
FIG. 1 (PRIOR ART)
FIG. 1 (Prior Art) illustrates a blocking diagram of a display architecture in a conventional personal computer system.
Figure 2:
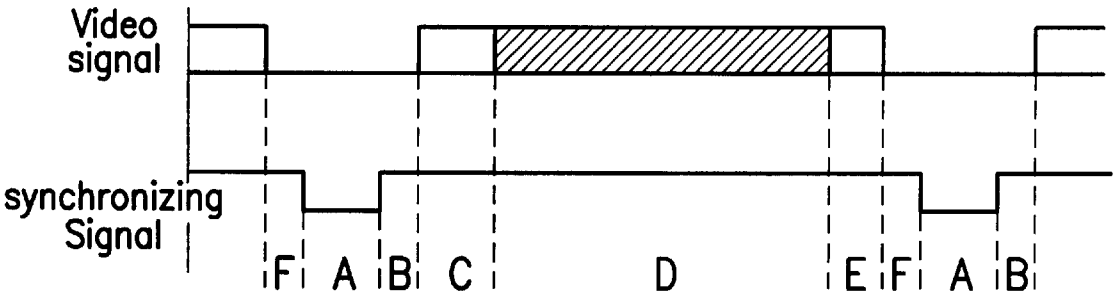
FIG. 2 (PRIOR ART)
FIG. 2 (Prior Art) illustrates timing charts of a video signal and a corresponding synchronizing signal.
Figure 3A:
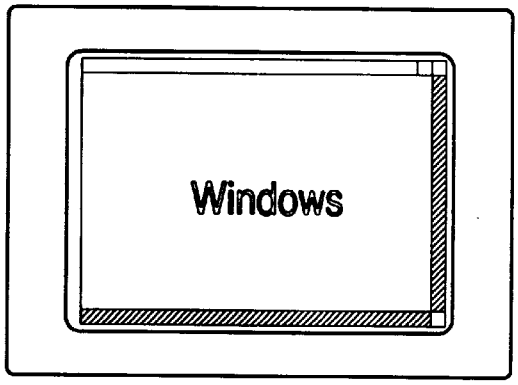
FIG. 3A (PRIOR ART)
FIG. 3A (Prior Art) illustrates a display screen of a computer system operated in a graphic environment and FIG. 3B (Prior Art) illustrates timing diagrams of the corresponding video signal and synchronizing signal.
Figure 3B:
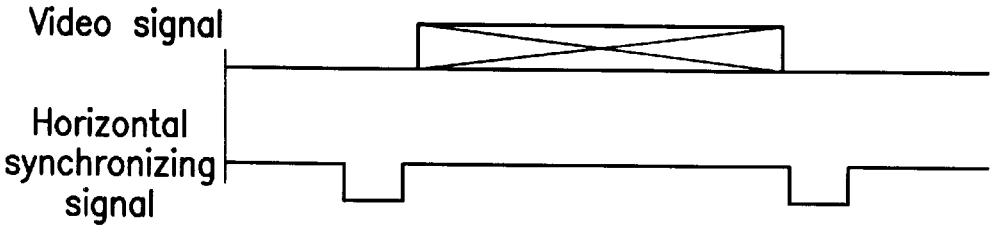
FIG. 3B (PRIOR ART)
FIG. 3C (Prior Art) illustrates a display screen of a computer system operated in a text environment and FIG. 3D (Prior Art) illustrates timing diagrams of the corresponding video signal and synchronizing signal.
Figure 3C:
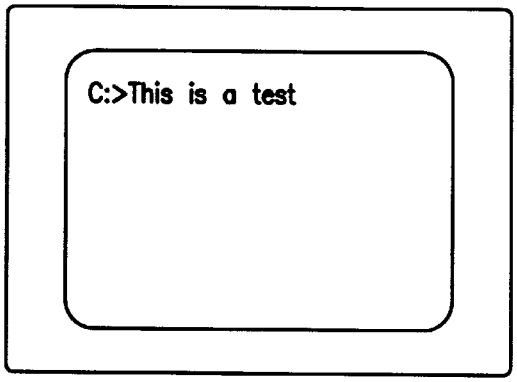
FIG. 3C (PRIOR ART)
Figure 3D:
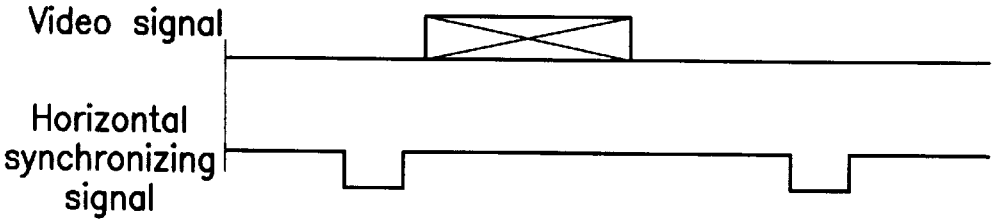
FIG. 3D (PRIOR ART)
Figure 4:
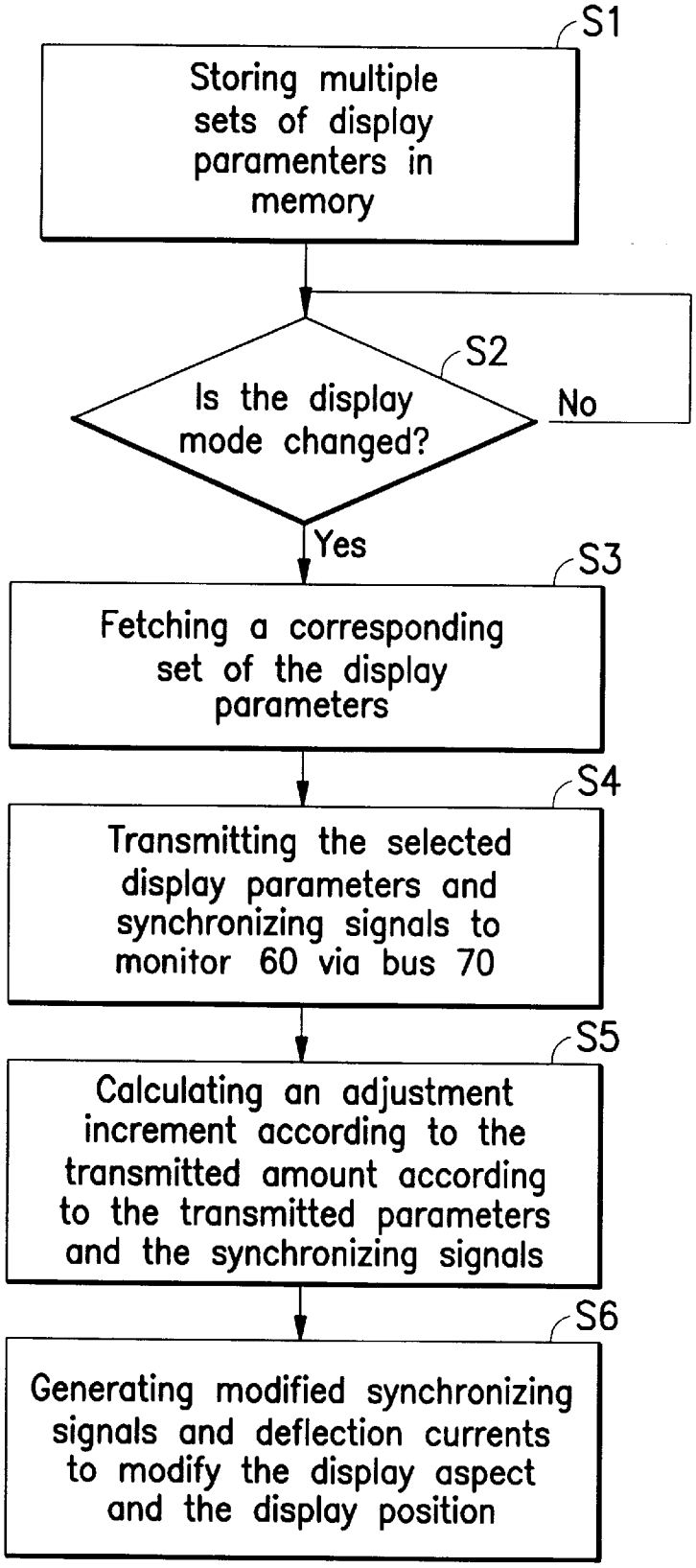
FIG. 4 shows a flowchart of a method of modifying the display aspect and the display position of a monitor in the first embodiment of the present invention.
Figure 5:
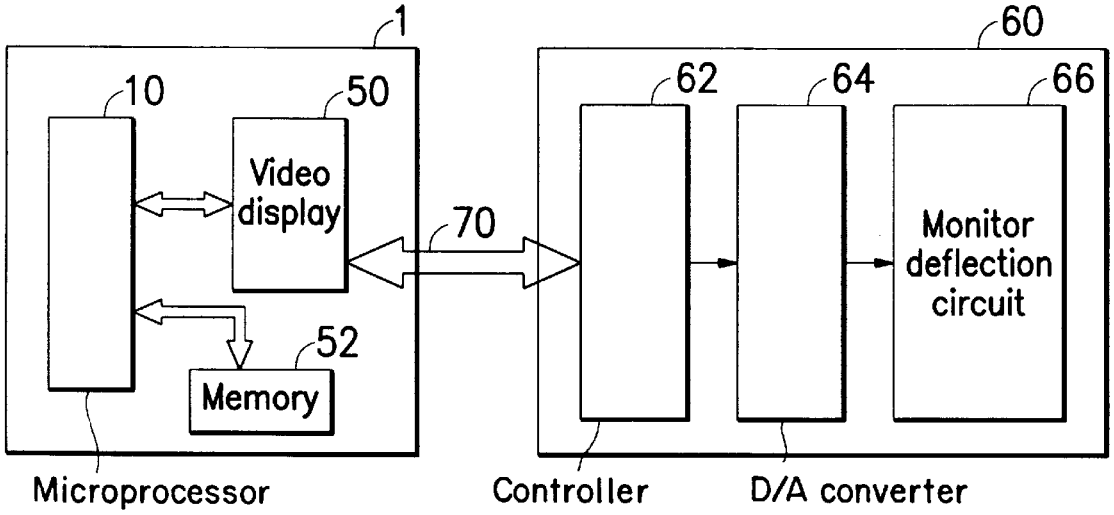
FIG. 5 shows a configuration of a computer system for modifying the display aspect and the display position of a monitor in the first embodiment of the present invention.

FIG. 4 shows a flowchart of a method of modifying the display aspect and the display position of a monitor in this embodiment and FIG. 5 shows a configuration of a computer system using the method shown in FIG. 4. The computer system shown in FIG. 5 includes computer 1 and monitor 60 connected to computer 1 via bus 70. Computer 1 includes microprocessor 10, video display card 50 and memory 52 for storing predefined display parameters corresponding to various display modes. Monitor 60 includes controller 62, digital-to-analog (D/A) converter 64 and monitor deflection-control circuit 66.

In the method shown in FIG. 4, first, a lot of display parameter sets are previously stored in memory 52 of computer 1 (Step S1). Each display parameter set is dedicated to one of the display modes that is acceptable to monitor 60. Each set includes display parameters of the front porch times and the back porch times of the horizontal synchronizing signal and the vertical synchronizing signal. If necessary, the total times and the synchronizing pulsed times of the horizontal synchronizing signal and the vertical synchronizing signal may also be included.

Microprocessor 10 of computer 1 or video display card 50 may detect whether the current display mode of the computer system needs to be changed or not during operation (Step S2). When the display mode needs to be changed, microprocessor 10, generally, may send an interruption instruction to request a response from video display card 50. Therefore, in such a mode-switching operation, microprocessor 10 and video display card 50 may be informed of the changing of the current display mode and the correct display mode to which they should switch. This detection procedure in step S2 may continue to be executed during operation, until a mode-changing situation occurs.

When detecting the changing of the display mode in the computer system, a display parameter set corresponding to the new display mode after change is fetched from memory 52 by microprocessor 10 or video display card 50 (Step S3). Then the fetched parameters are sent to monitor 60 via bus 70 connected between computer 1 and monitor 60 (Step S4). In addition, the synchronizing signals generated by video display card 50 may also be sent to monitor 60. Since the message transmitted from computer 1 to monitor 60 contains data format information, bus 70 must be a kind of interface bus capable of handling data format information. For example, universal serial buses (USB) and $I^2C$ access buses are two examples of these buses. However, it is understood by those skilled in the art that other interface buses capable of handling data format information can also be used in the present invention.

Finally, using the display parameters corresponding to the new display mode and the synchronizing signals generated by video display card 50, monitor 60 may generate modified synchronizing signals and deflection currents used for driving deflection yokes of the deflection circuit, thereby modifying the display aspect and the display position of monitor 60. In step S5, controller 62 generates an adjustment increment for the display aspect and the display position according to the selected display parameters and the synchronizing signals. In step S6, D/A converter 64 converts the adjustment increment into the modified synchronizing signals in accordance with the new display mode and the corresponding deflection currents. Then these modifying timing signals and currents are sent to monitor deflection circuit 66 to change the display aspect and the display position with respect to the new display mode. Therefore, monitor 60 may properly exhibit the monitor display.

The computer system at least includes three elements to achieve the purpose of modifying the display aspect and the display position: a memory device for previously storing display parameters corresponding to various display modes, a data-fetching device for retrieving a set of the display parameters corresponding to a new display mode when the display mode changes and a display-adjusting device for modifying the display aspect and the display position according to the retrieved display parameters.

Memory 52 shown in FIG. 5 serves as the memory device for storing the predefined display parameters. Since these display parameters must be present at the power-on of the computer system, memory 52 may be implemented by Read only Memories (ROM) or non-volatile Static Random Access Memories (SRAM). Memory 52 may be installed on a motherboard of computer 1, as shown in FIG. 5, or merged into video display card 50. Two benefits can be gained by merging memory 52 into video display card 50. The first one is that the display parameters stored in memory 52 may be arranged corresponding to the display modes supported by video display card 50. The second one is that the controller of video display card 50 does not need to access memory 52 via an external bus, thereby improving the processing speed.

The data-fetching device may be microprocessor 10 or the controller of video display card 50. In this embodiment, the selected display parameters are transmitted to monitor 60 via bus 70. Then the display-adjusting device is implemented by controller 62, D/A converter 64 and monitor deflection circuit 66.

Figure 6A:
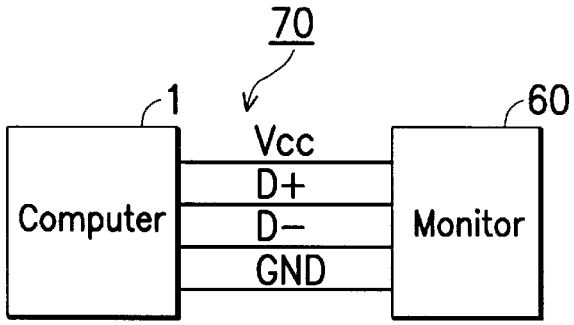
FIG. 6A shows a signal arrangement of the Universal Serial Bus (USB)
Figure 6B:
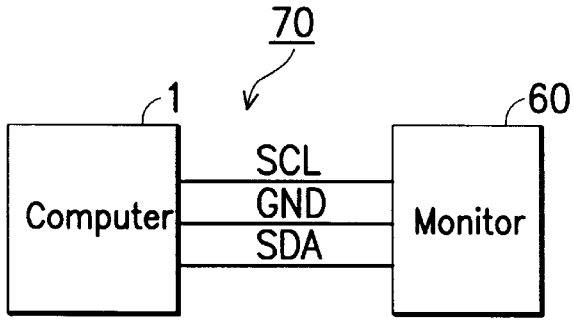
FIG. 6B shows a signal arrangement of the $I^2C$ access bus.

In addition, bus 70 between computer 1 and monitor 60 may be implemented by using spare pins of the conventional Video Graphics Array (VGA) interface. The transmission protocol of bus 70 may use the Universal Serial Bus (USB) or the $I^2C$ access bus. FIG. 6A and FIG. 6B show the signal arrangements of the USB and $I^2C$ access bus, respectively. In FIG. 6A, symbols VCC and GND represent a voltage source and a grounding terminal, respectively. D+ and D− denote a pair of differential data lines for transmitting data. In FIG. 6B, lines SCL and SDA are used for transmitting the clock signal and the data signal. Line SDA may transmit an information packet including addresses and data between a start bit and a stop bit. For example, the display parameters, including the front porch times, back porch times, synchronizing pulsed times and the total times of the horizontal/vertical synchronizing signals, may be divided into two parts, one for representing an integer fraction of the data and another for representing an decimal fraction of the data. Then the divided integer fractions and the decimal fractions are sequentially transmitted through the interface.

Figure 7:
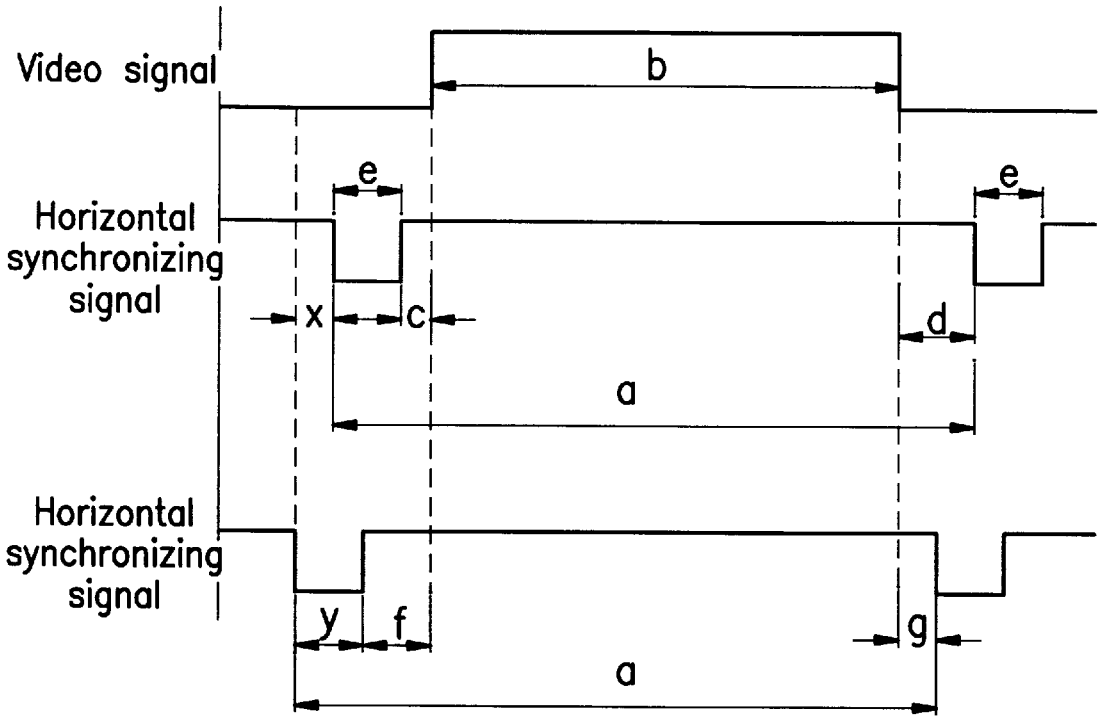
FIG. 7 illustrates timing diagram of a video signal, a horizontal synchronizing signal and a horizontal blanking signal used in the calculation example.

The following calculation examples illustrate the practical procedures of adjusting H-phase and H-size. FIG. 7 illustrates the timing diagram of a horizontal synchronizing signal, a video signal corresponding to the horizontal synchronizing signal and a horizontal blanking signal replicated by the monitor. In FIG. 7, the periods of the horizontal synchronizing signal and blanking signal are designated as symbol a. Symbols e and y represent the pulsed times of the horizontal synchronizing signal and blanking signal, respectively. Other time parameters are defined by referring to FIG. 7. With respect to the H-phase adjustment, the adjustment objective is to move the display into the center zone. In other words, the relation of f=g must be satisfied. Therefore, $$f=g=a-b-y/2 \quad (1)$$

In addition, the timing relation in the left portion of FIG. 7 is stated as follows:

$$x+e+c=f+y=a-b-y/2+y \quad (2)$$

According to Equation (2), parameter x may be expressed as:

$$x=a+y-b/2-c-e \quad (3)$$

The H-phase adjustment process can be performed according to Equation (3). In other words, the relation of f=g, which means the display position located in the center of the display screen, is satisfied when parameter x is equal a+y−b/2−c−e. It should be noted that parameters a, y, b, c and e are known. Therefore, the monitor controller may detect falling edges of the pulses of the horizontal synchronizing signal and the horizontal blanking signal, and determine whether the distance between these falling edges is equal to parameter x or not. When the distance between the falling edges differs from parameter x, the monitor controller may continuously adjust the horizontal blanking signal until they are the same. Such an adjustment procedure may also be applied to modifying the vertical display position.

Optimized parameters previously stored in monitor must be utilized to adjust H-size. More precisely, the relation between the fraction of (a−e)/b and a pulse-width modulating parameter $H_{PWM}$ (or called field values of the monitor) with respect to the horizontal size remains constant during the adjustment procedure. For example, the pre-stored pulse-width modulating parameter $H_{PWM}$ with respect to the horizontal size is 50, and the optimized parameters a, b and e are set as:

a=104 characters;

b=80 characters;

e=4 characters.

Note that the "character" is a representation of the display parameter value, indicating the practical displayed pixel width corresponding to the time values at a specific horizontal scanning frequency. In brief, when the ratio of (a−e)/b=1.25 and $H_{PWM}$=50 are simultaneously satisfied, the horizontal size is optimized. Accordingly, when the ratio of (a−e)/b calculated by the practical video signals and the synchronizing signals deviates from the optimized value of 1.25, the pulse-width modulating parameter $H_{PWM}$ must also be adjusted. For example, the practical parameters a, e and b associated with the video signals and synchronizing signals generated by the video display card are:

a=128 characters;

b=100 characters; and e=9 characters;

in which the ratio of (a−e)/b=(128−9)/100=1.19. Accordingly, the pulse-width modulating parameter $H_{PWM}$ must be adjusted to 50×(1.19/1.25)=47.6. Such an adjustment procedure may also be applied to modifying the vertical display size.

Second Embodiment

Figure 8:
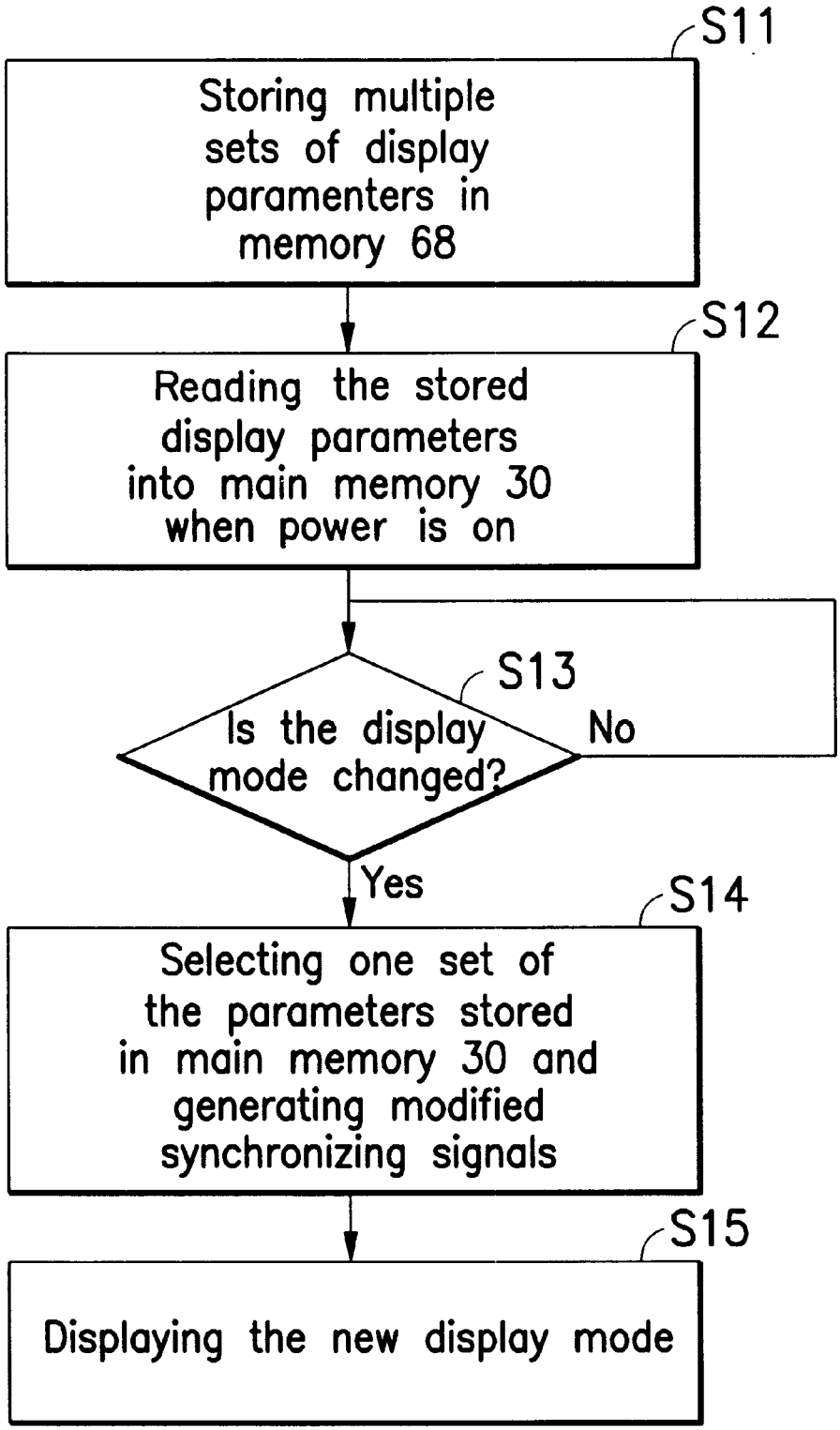
FIG. 8 shows a flowchart of a method of modifying the display aspect and the display position of a monitor in the second embodiment of the present invention.
Figure 9:
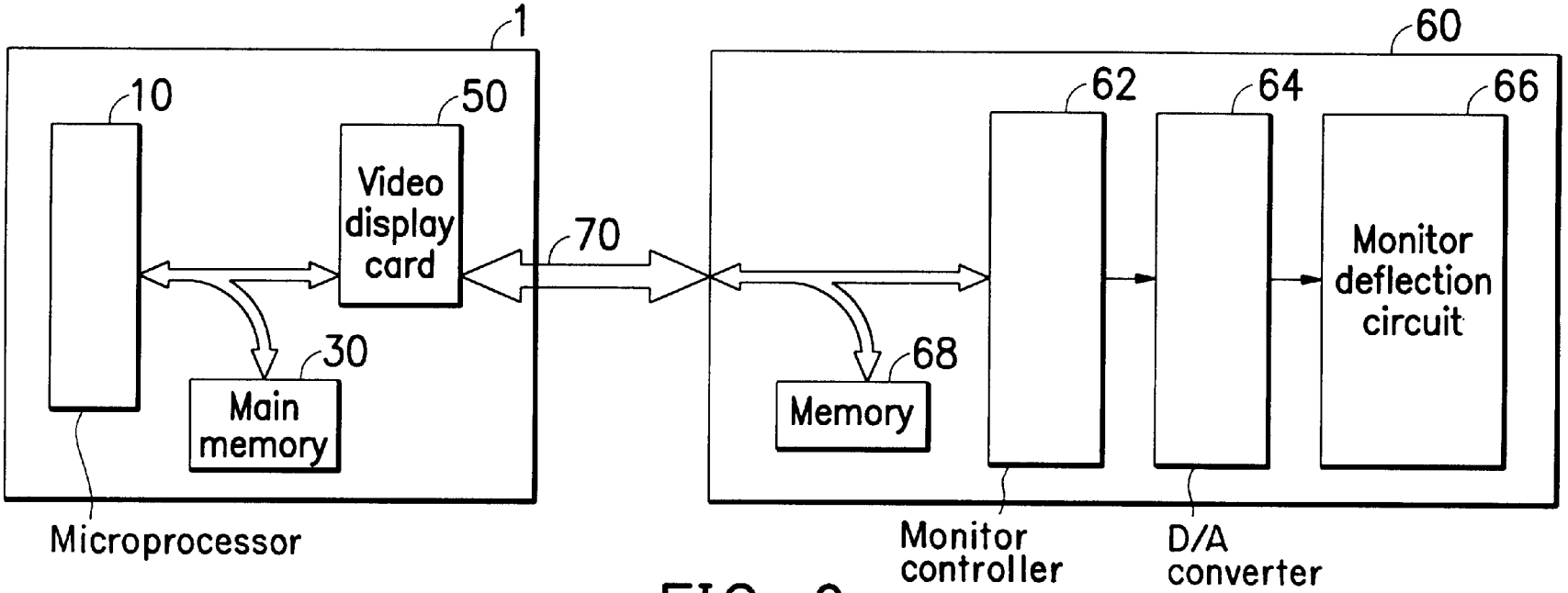
FIG. 9 shows a configuration of a computer system for modifying the display aspect and the display position of a monitor in the second embodiment of the present invention.

FIG. 8 shows a flowchart of a method of modifying the display aspect and the display position of a monitor in the second embodiment and FIG. 9 shows a configuration of a computer system using the method shown in FIG. 8. The computer system shown in FIG. 9 includes computer 1 and monitor 60 connected to computer 1 via bus 70, similar to the configuration shown in FIG. 5. Computer 1 includes microprocessor 10 and video display card 50. Monitor 60 includes monitor controller 62 and memory 68 for storing predefined display parameters corresponding to various display modes.

In the method shown in FIG. 8, first, a plurality of display parameter sets corresponding to various display modes are stored in memory 68 (Step S11). In this embodiment, memory 68 is installed in monitor 60. Each display parameter set includes the front porch times, the back porch times, the total times and the synchronizing pulsed times of the horizontal synchronizing signal and the vertical synchronizing signal.

When powered on, computer 1 fetches the stored display parameters and stores the fetched parameters in main memory 30 (Step S12). Such an arrangement may simplify the monitor setup process. That is, users do not need to install a monitor driver, thereby achieving the effect of "Plug & Play." Microprocessor 10 of computer 1 or video display card 50 may detect whether the current display mode of the computer system needs to be changed or not during operation (Step S13). Such a detection operation is continuously executed during operation until a condition of switching display mode occurs.

When the computer system needs to be changed, microprocessor 10 then fetches a set of the display parameters from main memory 30 corresponding to a new display mode and transmits the fetched values to video display card 50. Video display card 50 then generates modified synchronizing signals associated with the new display mode according to the transmitted display parameters (Step S4).

Finally, monitor 60 recognizes the changing of the display mode and then switches to the new corresponding display mode (Step S15). Using D/A converter 64 and monitor deflection circuit 66, monitor 60 may adjust the display aspect and the display position according to the new display mode.

In this embodiment, the computer system also at least includes three elements to achieve the purpose of modifying the display aspect and the display position: a memory device for previously storing display parameters corresponding to various display modes, a data-fetching device for retrieving the display parameters corresponding to a new display mode when the display mode changes and a display-adjusting device for modifying the display aspect and the display position according to the retrieved display parameters.

Memory 68 shown in FIG. 9 serves as the memory device for storing the predefined display parameters. Since these display parameters must be present at the power-on of the computer system, memory 68 may be implemented by Read Only Memories (ROM) or non-volatile Static Random Access Memories (SRAM). In this embodiment, memory 58 may be installed in monitor 60. The data-fetching device may be microprocessor 10 or the controller of video display card 50. In this embodiment, all the display parameters stored in monitor 60 are transmitted to computer 1 via bus 70 at initial power-on. Then the function of the display-adjusting device is achieved by microprocessor 10 or the controller of video display card 50.

The foregoing description of preferred embodiments of the present invention has been provided for the purposes of illustration and description. It is not intended to be exhaustive or to limit the invention to the precise forms disclosed. Many modifications and variations will be apparent to practitioners skilled in the art. The embodiments were chosen and described to best explain the principles of the invention and its practical application, thereby enabling others skilled in the art to understand the invention to practice various other embodiments and make various modifications suited to the particular use contemplated. It is intended that the scope of the invention be defined by the following claims and their equivalents.

What is claimed is:

1. A method of modifying the display position of a monitor for a computer system when the display mode of said computer system changes, said computer system having a built-in video-output device, said monitor being connected to said video-output device via a bus, said video-output device supplying a synchronizing signal and a video signal to said monitor, the synchronizing signal having a synchronizing signal period, said method comprising the steps of:

previously maintaining a plurality of display parameter sets related to said synchronizing signal and said video signal in said computer system, each of said display parameter sets corresponding to a display mode of said computer system;

selecting one of the display parameter sets when the display mode of said computer system changes, the selected display parameter set corresponding to a new display mode after change;

transmitting the selected display parameter set to said monitor via said bus;

generating a replicated signal in said monitor, said replicated signal having a period which is substantially equal to the synchronizing signal period, said replicated signal having a predetermined pulsed time, and a phase difference existing between said replicated signal and said synchronizing signal;

generating an adjustment increment to adjust the phase difference between said replicated signal and said synchronizing signal, according to the selected display parameter set and said pulsed time of said replicated signal; and modifying the replicated signal to change the display position according to the adjustment increment.

2. The method of claim 1 wherein the new display mode after change is detected by a processor of said computer system.

3. The method of claim 1 wherein each display parameter set includes the front-porch times and the back-porch times of the synchronizing signals.

4. The method of claim 3 wherein each display parameter set further includes the pulsed times and the total times of the synchronizing signals.

5. The method of claim 1 wherein said video-output device is a video display card.

6. The method of claim 1 wherein said video-output device is a display chip installed in said computer system.

7. An apparatus for modifying the display position of a monitor for a computer system when the display mode of said computer system changes, said computer system having a built-in video-output device which supplies a synchronizing signal and a video signal to said monitor, said monitor being connected to said video-output device via a bus and said monitor generating a replicated signal associated with said synchronizing signal, with a phase difference existing between said replicated signal and said synchronizing signal said apparatus comprising:

memory means for storing a plurality of display parameter sets related to said synchronizing signal and said video signal in said computer system, each of said display parameter sets corresponding to a display mode of said computer system;

data-fetching means for retrieving one of the display parameter sets corresponding to a new display mode when the display mode of the computer system changes; and display-adjusting means for generating an adjustment increment to adjust the phase difference between said replicated signal and said synchronizing signal according to the retrieved display parameter set and a predetermined pulsed time of said replicated signal, to modify the display position of said monitor.

8. The apparatus of claim 7 wherein said memory means is installed in said computer system.

9. The apparatus of claim 7 wherein said memory means is installed in said monitor.

10. The apparatus of claim 7 wherein said data-fetching means is a processor installed in said computer system.

11. The apparatus of claim 7 wherein said display-adjusting means is installed in said monitor.

12. The apparatus of claim 7 wherein said video-output device is a video display card.

13. The apparatus of claim 7 wherein said video-output device is a display chip installed in said computer system.

14. The method of claim 1 wherein said adjustment increment is calculated to make the phase difference between said replicated signal and said synchronizing signal equal to the time duration, $x=^{a+30}\ y-b/2-c-e$, wherein a is the period of said synchronizing signal and replicated signal, b is the time duration of said video signal in each period of said synchronizing signal, c is the back-porch time of said synchronizing signal, e is the pulsed time of said synchronizing signal, and y is the pulsed time of said replicated signal.

15. A method of modifying the display size of a monitor for a computer system when the display mode of said computer system changes, said computer system having a built-in video-output device, said monitor being connected to said video-output device via a bus, said video-output device supplying a synchronizing signal and a video signal to said monitor, the display size of said monitor being controlled by a deflection voltage applied to a deflection circuit of said monitor, said method comprising the steps of:

previously maintaining a plurality of display parameter sets related to said synchronizing signal and said video signal in said computer system, each of said display parameter sets corresponding to a display mode of said computer system;

previously defining a pre-stored time duration ratio related to said synchronizing signal and said video signal;

selecting one of the display parameter sets when the display mode of said computer system changes, the selected display parameter set corresponding to a new display mode after change;

transmitting the selected display parameter set to said monitor via said bus;

generating an adjustment increment according to the selected display parameter set and said pre-stored time duration ratio; and adjusting the voltage supplied to said deflection circuit to change the display size according to the adjustment increment.

16. The method of claim 15 wherein said synchronizing signal has a period and a pulsed time, said video signal has a time duration in each period of said synchronizing signal, and said adjustment increment is calculated to make the time duration ratio (a−e)/b substantially equal to said pre-stored time duration ratio, where a is the period of said synchronizing signal, b is the time duration of said video signal in each period of said synchronizing signal, and e is the pulsed time of said synchronizing signal.

17. An apparatus for modifying the display size of a monitor for a computer system when the display mode of said computer system changes, said computer system having a built-in video-output device which supplies a synchronizing signal and a video signal to said monitor; the display size of said monitor being controlled by a deflection voltage applied to a deflection circuit of said monitor; said monitor being connected to said video-output device via a bus, where a pre-stored time duration ratio related to said synchronizing signal and said video signal is provided, said apparatus comprising:

memory means in said computer system for storing a plurality of display parameter sets related to said synchronizing signal and said video signal in said computer system, each of said display parameter sets corresponding to a display mode of said computer system;

data-fetching means in said computer system for retrieving one of the display parameter sets transmitted to said monitor via said bus, each of said display parameter sets corresponding to a new display mode when the display mode of the computer system changes; and display-adjusting means in said monitor for generating an adjustment increment according to the retrieved display parameter set and said pre-stored time duration ratio, so as to modify the display size of said monitor by modifying the voltage applied to said deflection circuit.

18. The apparatus of claim 17 wherein the synchronizing signal has a period and a pulsed time, the video signal has a time duration in each period of the synchronizing signal, and said display-adjusting means are operative for generating the adjustment increment according to the difference between the time duration ratio (a−e)/b and said pre-stored time duration ratio, where a is the period of said synchronizing signal, b is the time duration of said video signal in each period of said synchronizing signal, and e is the pulsed time of said synchronizing signal.

* * * * *